US005181485A

United States Patent [19]

Hirose et al.

[11] Patent Number: 5,181,485

[45] Date of Patent: Jan. 26, 1993

[54] VALVE DRIVING MECHANISM FOR DOUBLE OVERHEAD CAMSHAFT ENGINE

[75] Inventors: Ichiro Hirose; Tomohisa Handa; Noriyuki Iwata; Masahiro Chosh:, all of Hiroshima, Japan

[73] Assignee: Mazda Motor Corporation, Hiroshima, Japan

[21] Appl. No.: 675,612

[22] Filed: Mar. 27, 1991

[30] Foreign Application Priority Data

Mar. 29, 1990 [JP] Japan ..... 2-81548
May 24, 1990 [JP] Japan ..... 2-54787[U]

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2

[56] References Cited

U.S. PATENT DOCUMENTS

| | | | |
|---|---|---|---|
| 4,535,731 | 8/1985 | Banfi | 123/90.15 |
| 4,674,452 | 6/1987 | Asanomi | 123/90.31 |
| 4,993,370 | 2/1991 | Hashiyama et al. | 123/90.17 |
| 5,012,773 | 5/1991 | Akasaka et al. | 123/90.31 |
| 5,012,774 | 5/1991 | Strauber et al. | 123/90.17 |

*Primary Examiner*—E. Rollins Cross
*Assistant Examiner*—Weilun Lo
*Attorney, Agent, or Firm*—Keck, Mahin & Cate

[57] ABSTRACT

A valve driving mechanism for a double overhead camshaft engine includes a camshaft drive mechanism, including a camshaft sprocket for transmitting engine output from a crankshaft of the engine to one of intake and exhaust camshafts. A valve timing varying mechanism is driven so as to vary a valve timing of, for example, a set of intake valves relative to a valve timing of a set of exhaust valves. The valve timing varying mechanism includes a first helical gear, mounted on the exhaust camshaft for rotation, a second helical gear, in mesh with the first helical gear, which is rigidly secured to the intake camshaft, and a cylindrical sliding element, mounted on the exhaust camshaft for axial displacement. The cylindrical sliding element operationally couples the exhaust camshaft to the camshaft drive mechanism so as to cause a relative rotational displacement therebetween when the cylindrical sliding element undergoes axial displacement with respect to the exhaust camshaft.

11 Claims, 8 Drawing Sheets

VALVE DRIVING MECHANISM FOR DOUBLE OVERHEAD CAMSHAFT ENGINE

The present invention relates to a valve driving mechanism for an engine, and, more particularly, to a valve driving mechanism for a double overhead camshaft engine which is equipped with a mechanism for varying valve timing.

BACKGROUND OF THE INVENTION

1. Field of the Invention

Typically, a double overhead camshaft engine is provided with a pair of overhead camshafts for opening and closing intake and exhaust valves, respectively, at a desired valve timing. The overhead camshafts, either one of which is operationally coupled by a drive belt for rotation to a crankshaft, are operationally coupled to each other by a gear mechanism, so as to turn simultaneously.

2. Description of Related Art

A gear mechanism for operationally coupling a pair of overhead camshafts for driving, i.e., opening and closing, intake and exhaust valves includes camshaft gears coaxial with and attached to one end of each of the overhead camshafts. Providing such a gear mechanism allows the overhead camshafts to be located closer to each other, thereby allowing intake and exhaust valves to be located closer to each other and arranged at a small relative angle with respect to a center axis of a cylinder. Because this overhead camshaft mechanism enables an engine body to be constructed so that it is small and compact in size and to be provided with a simple combustion chamber structure, the engine can be improved in fuel combustion efficiency, and hence in fuel economy.

It is widely known to provide the double overhead camshaft engine with a variable valve timing mechanism in order to vary valve timings according to engine operating conditions, such as engine speeds. For instance, in order for the double overhead camshaft engine to have desired engine output properties during idling as well as in ranges of both middle and high engine speeds, it is necessary for valve overlap to be short in time, or small in degree, during idling, and to be longer in time, or larger in degree, at middle and high engine speeds.

To vary valve timing, it is known to provide a variable valve timing mechanism which comprises a camshaft drive pulley, or sprocket, that is driven by a crank pulley, or sprocket, and which is supported, for rotation, by a drive camshaft driven by the crankshaft. The relative angle between the cam pulley and drive camshaft is changed by a pneumatic control mechanism. Such a variable valve timing mechanism is known from, for instance, Japanese Unexamined Utility Model Publication No. 62-57711.

In the variable valve timing mechanism disclosed in the above publication, if helical splines in the variable valve timing mechanism and helical gears for connecting the drive and driven camshafts are used, a large thrust is transferred to the driven camshaft as the valve timing is varied, and the variable valve timing mechanism is prevented from acting smoothly That is, at the beginning or end of a varying operation of the variable valve timing mechanism, a reactive thrust force is imposed on the drive camshaft by the helical gears, and is transmitted to the driven camshaft from the drive camshaft. Accordingly, the driven camshaft undergoes a large lengthwise displacement, due to the transmitted reactive thrust force, in addition to a reactive force produced by torsion produced by the helical gears. If the valve driving system produces a change in driving torque and transmits it to the camshafts, the reactive thrust force increases greatly, and the camshafts adversely affect their mounting elements. A reactive force from the helical gears is transmitted as a thrust to the variable valve timing mechanism, so as to prevent the variable valve timing mechanism from returning smoothly and thereby to increase a delay in operational response.

Furthermore, because of the fact that the drive camshaft is attached with the cam pulley operationally coupled to the crank pulley by a belt, the drive camshaft is, during engine operation, applied with an excess loading by the belt. For this reason, the variable valve timing mechanism, installed at an end of the drive camshaft, is supported in a cantilevered fashion, so as to be possibly structurally unstable. In order for the drive camshaft to resist the loading imposed by the belt, it is preferable that the loading be borne by a portion as close to the variable valve timing mechanism as possible, as well as to have the longest bearing length and the largest bearing surface area possible.

The overhead camshafts, for intake and exhaust valves, must be exactly positioned in a thrust, or lengthwise, direction. More particularly, it is desirable to have the drive camshaft attached with the camshaft drive sprocket positioned, in the lengthwise direction, by a bearing located near the camshaft drive sprocket. This is because a relative displacement is produced in the lengthwise direction between the drive and driven camshafts, due to thermal expansion of the drive camshaft, which causes a displacement of engagement between gears of the drive and driven camshafts, which are in mesh with each other.

For these reasons, the drive camshaft, supported by the bearing near the camshaft drive sprocket and the variable valve timing mechanism, is required to have a high structural strength. Providing the drive camshaft with a sufficient structural strength is accompanied by an increase in length of the bearing bore and, accordingly, an increase in length of the drive camshaft itself. This leads to an increased engine size.

SUMMARY OF THE INVENTION

A primary object of the present invention is, therefore, to provide a valve drive mechanism for a double overhead camshaft engine which decreases a reactive thrust force transmitted to a camshaft which is produced during the operation of a variable valve timing mechanism.

Another object of the present invention is to provide a valve drive mechanism for a double overhead camshaft engine which does not apply a large thrust force to a bearing for positioning a drive camshaft in its lengthwise direction, even though the bearing is made large in size, and which provides the bearing with sufficient structural strength.

These objects are accomplished by a valve drive mechanism for a double overhead camshaft internal combustion engine which has an intake overhead camshaft, having one cam for driving each intake valve of the internal combustion engine, and an exhaust overhead camshaft, in juxtaposition with the intake overhead camshaft, which has one cam for driving each exhaust valve of the internal combustion engine and is operationally coupled to the intake overhead camshaft. Engine output is transmitted from a crankshaft of the internal combustion engine to either one of the intake and exhaust overhead camshafts by camshaft drive means, including a camshaft drive sprocket, or pulley, connected to the one of the intake and exhaust overhead camshafts. Valve timing varying means, provided between the camshaft drive sprocket and the camshafts, varies a valve timing at which either one of the intake and exhaust valves is driven relative to a valve timing at which the other of the intake and exhaust valves is driven. The valve timing varying means includes first gear means, mounted on the one of the intake and exhaust overhead camshafts for rotation, second gear means, in mesh with said first gear means and rigidly secured to the other of the intake and exhaust overhead camshafts, and cylindrical sliding means, mounted on the one of the intake and exhaust overhead camshafts for axial displacement. The cylindrical sliding means operationally couples the one of the intake and exhaust overhead camshafts to the camshaft drive means so as to cause a relative rotational displacement therebetween when the cylindrical sliding means is axially displaced with respect to the one of the intake and exhaust overhead camshafts. In particular, the cylindrical sliding means comprises an annular hydraulic piston formed with internal and external helical coupling means, such as helical splines cut in opposite directions, so that it is coupled to the one of the intake and exhaust overhead camshafts and to the camshaft drive means, respectively.

The valve drive mechanism further comprises thrust restraining means for allowing a greater lengthwise movement of the one of the intake and exhaust overhead camshafts than of the other. The one of the intake and exhaust overhead camshafts is supported and positioned lengthwise by tightly holding a bearing located on the internal combustion engine between the first gear means and a housing of the cylindrical sliding element.

The first gear means may be rigidly secured to the one of the intake and exhaust overhead camshafts for rotation. In this case, the cylindrical sliding means causes a relative rotational displacement between the camshaft drive mechanism and both the intake and exhaust camshafts when axial displacement of the cylindrical sliding means with respect to the one of the intake and exhaust overhead camshafts is caused.

BRIEF DESCRIPTION OF THE DRAWINGS

The above and other objects and features of the present invention will be apparent from the following description of preferred embodiments thereof when considered together with the accompanying drawings, wherein similar reference numbers have been used to denote the same or similar elements throughout the drawings, and in which.

DETAILED DESCRIPTION OF THE PREFERRED EMBODIMENTS

Figure 1:
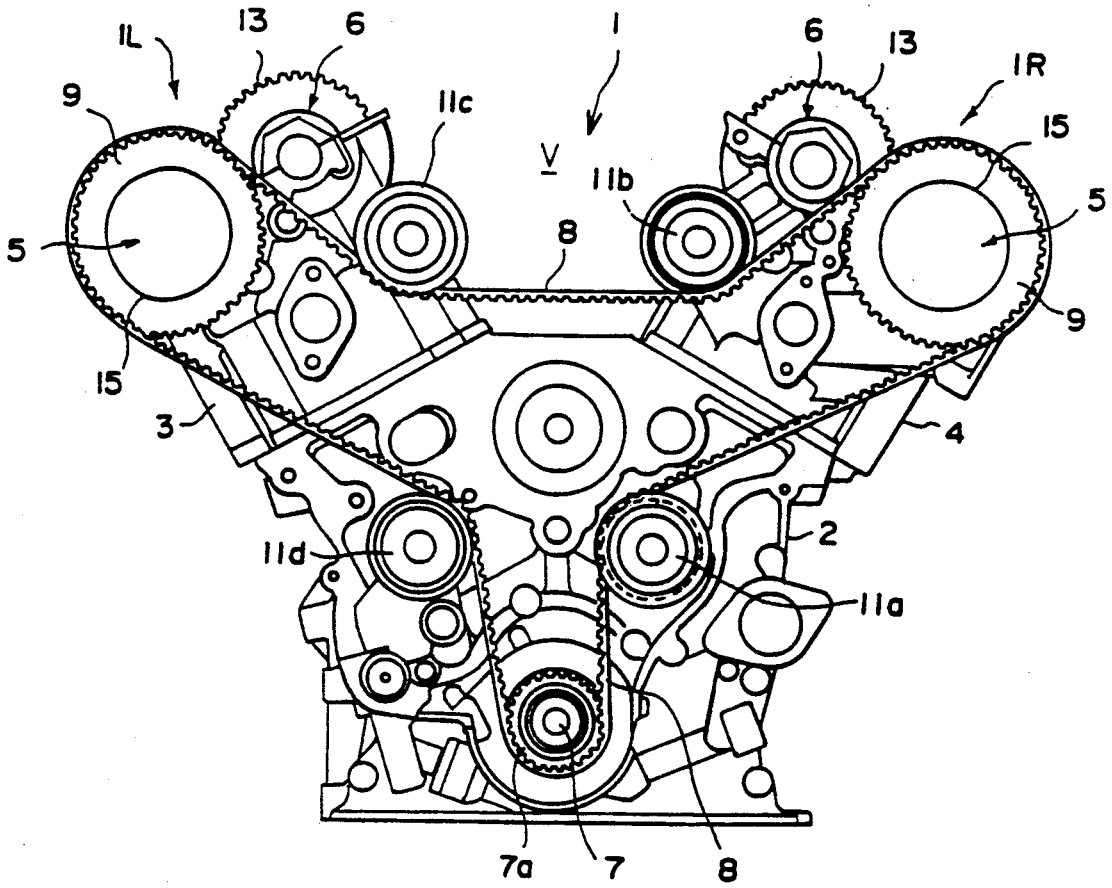
FIG. 1 is a front view of a V-6, double overhead camshaft engine with a valve drive mechanism in accordance with a preferred embodiment of the present invention.
Figure 2:
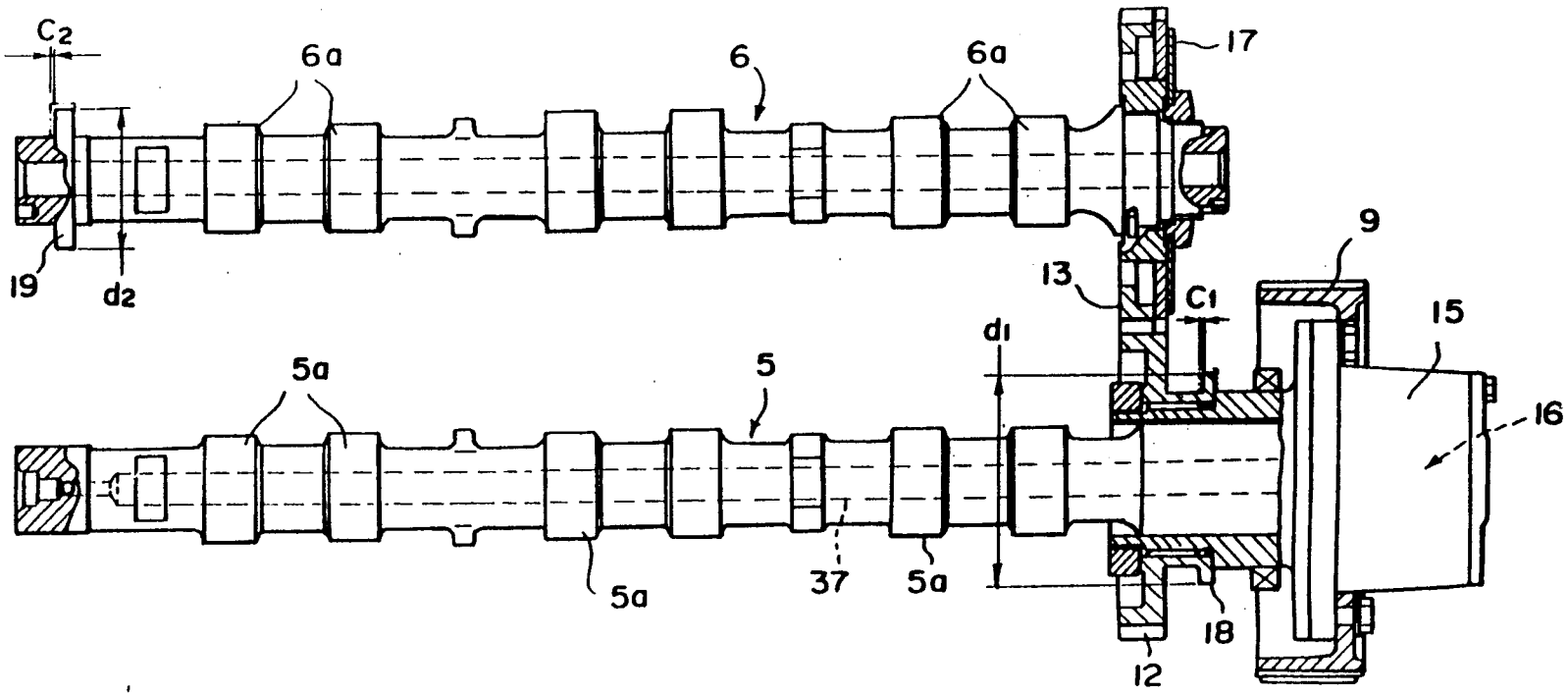
FIG. 2 is a plan view of double overhead camshafts of the engine of FIG. 1.

Referring to the drawings in detail, and particularly to FIGS. 1 to 4, an engine body 1 of a V-6, double overhead camshaft engine, equipped with a valve drive mechanism in accordance with a preferred embodiment of the present invention, is shown. The engine body includes left and right cylinder banks 1L and 1R, arranged in a V-formation. A predetermined relative angle, for example, a relative angle of 60 degrees, is provided between centerlines of the cylinder banks 1L and 1R. The engine 1 has a cylinder block 2, provided with six cylinders. Each cylinder is provided with two intake valves and two exhaust valves. A left cylinder head 3 is mounted on the cylinder block 2 and provides for the left cylinder bank 1L, and a right cylinder head 4 is mounted on the cylinder block 2 and provides for the right cylinder bank 1R.

Engine 1 is equipped with two pairs of exhaust and intake overhead camshafts 5 and 6, functioning as drive and driven camshafts, respectively, which form the valve drive mechanism. The camshafts are arranged in juxtaposition above a crankshaft 7 in the upper part of each of the cylinder heads 3 and 4. Each exhaust camshaft 5, which is located remote from a V-shaped space V between the left and right cylinder banks 1L and 1R and is formed with one cam 5*a* for each exhaust valve (not shown), is mounted for rotation on the cylinder head 3 so as to drive, or open and close, each respective exhaust valve. The intake camshaft 6, which is located adjacent to the V-shaped space V and is formed with one cam 6*a* for each intake valve (not shown), is mounted for rotation on the cylinder head 4 so as to drive, or open and close, each respective intake valve. The valve drive mechanism further comprises a drive camshaft gear, or sprocket, 9, helical gears 12 and 13, timing belt 8 and idle pulleys 11*a*–11*d*. The drive camshaft sprocket 9 is mounted on one end of each exhaust camshaft 5, and is coupled to a drive pulley, or sprocket, 7*a*, rigidly secured to one end of the crankshaft 7, by the timing belt 8, which transmits the engine output to the drive camshaft sprocket 9. The helical gears 12 and 13, operationally connecting the exhaust and intake camshafts 5 and 6 to each other, will be described in detail later. The idle pulleys 11*a*–11*d* are biased, e.g., by springs, so as to impose a proper tension on the timing belt 8.

Camshaft drive means, such as a pulley or sprocket 9, of the exhaust camshaft 5 is actually supported by, or mounted on, a cylindrical housing 15, which is rigidly fixed to the end of the exhaust camshaft 5. The housing 15 includes therein a pneumatically operated variable valve timing mechanism 16 for varying a phase angle of rotation of the exhaust camshaft 5 relative to the intake camshaft 6, which will be described in detail with reference to FIG. 5 later, so as to vary the valve overlap between the intake and exhaust valves.

First gear means, such as a first helical gear 12, which is mounted on the exhaust camshaft 5, is fixed to the housing. The first helical gear 12 is formed with an integral flange 18, extending toward the housing 15, for controlling thrust caused by lengthwise movement of the housing 15. A second gear means, such as a second helical gear 13, in mesh with the first helical gear 12, is fixed to one end of the intake camshaft 6. The second helical gear 13 is provided with a friction gear 17, which is well known as a backlash eliminating element. The intake camshaft 6 is provided, at the other end remote from the end where the second helical gear 13 is attached, with a flange 19 for controlling thrust caused by lengthwise movement of the intake camshaft 6.

Figure 3:
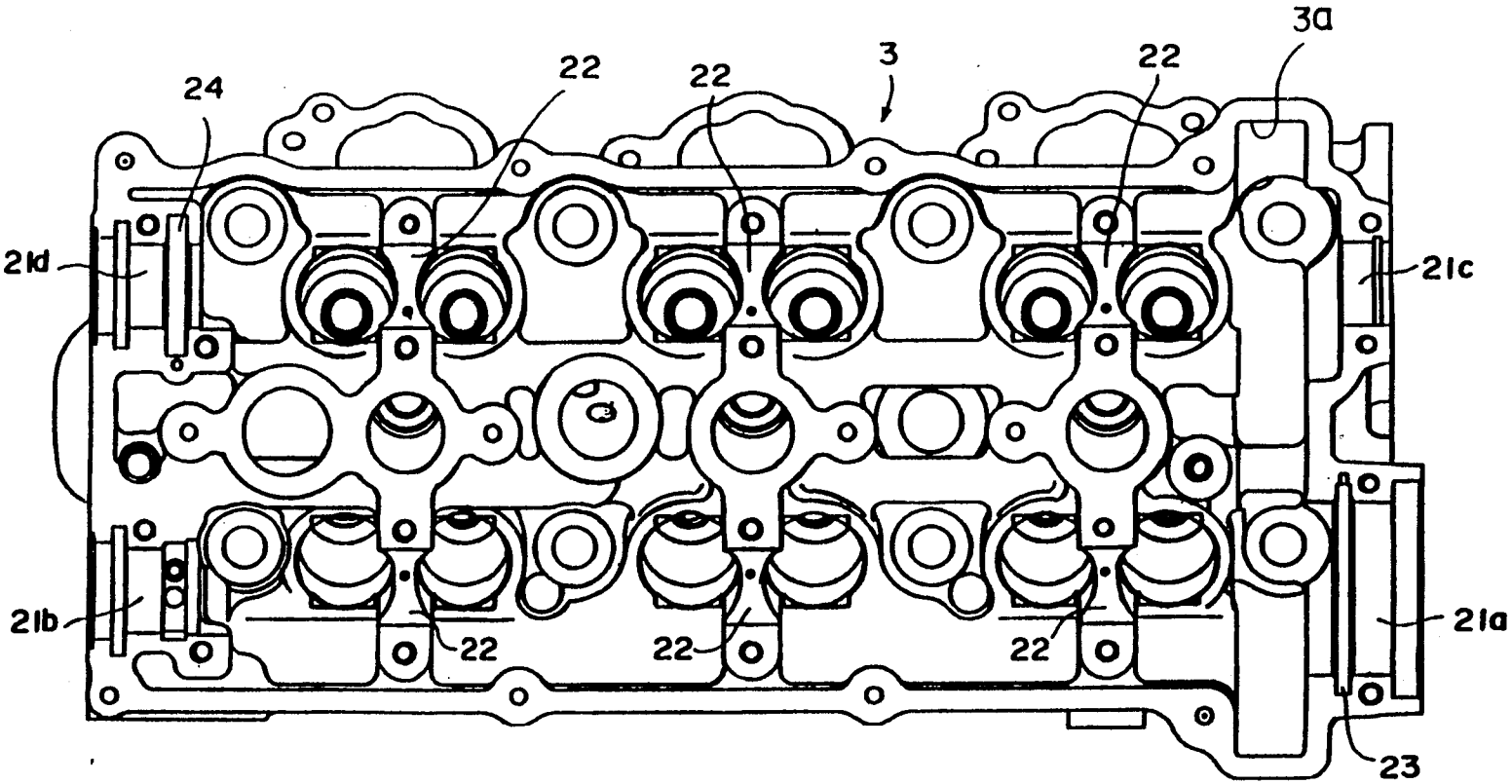
FIG. 3 is a top view of a cylinder head of one cylinder bank of the engine of FIG. 1.

Referring to FIG. 3, there is shown the top of the cylinder head 3, mounting thereon the camshafts 5 and 6. The top of the cylinder head 4 is a mirror image of but otherwise substantially identical to the top cylinder head 3. The cylinder head 3 is integrally formed at opposite ends with lower halves of front and rear journal bearings 21*a*, 21*b*, 21*c* and 21*d* for the camshafts 5 and 6, respectively. The cylinder head 3 is further integrally formed, between opposite ends, with three intermediate lower halves of bearings 22 for each camshaft 5 or 6. Adjacent to the front journal bearings 21*a* and 21*c*, there is provided a space, or gear chamber 21*a*, in which the first and second helical gears 12 and 13 are rotatably received.

Front lower half of journal bearing 21*a* for the exhaust camshaft 5 is formed with a semi-circular groove 23 which receives therein the flange 18 integral with the first helical gear 12 and prevents the lengthwise movement of the housing, and hence of the exhaust camshaft 5. Similarly, the rear lower half of journal bearing 21*d* for the intake camshaft 6 is formed with a semi-circular groove 24, which receive therein the flange 19 fixed to the intake camshaft 6 and prevents the lengthwise movement of the intake camshaft 6. The flange 19 is formed so as to have a diameter d2 smaller than a diameter d1 of the flange 18, and to provide an axial clearance C2 between the semicircular groove 24 which is larger than an axial clearance C1 provided between the flange 18 and the groove 23. The axial clearance C2 is designed so as to be larger than the axial clearance C1, even after a possible thermal expansion of the intake camshaft 6 in the lengthwise direction.

Figure 4:
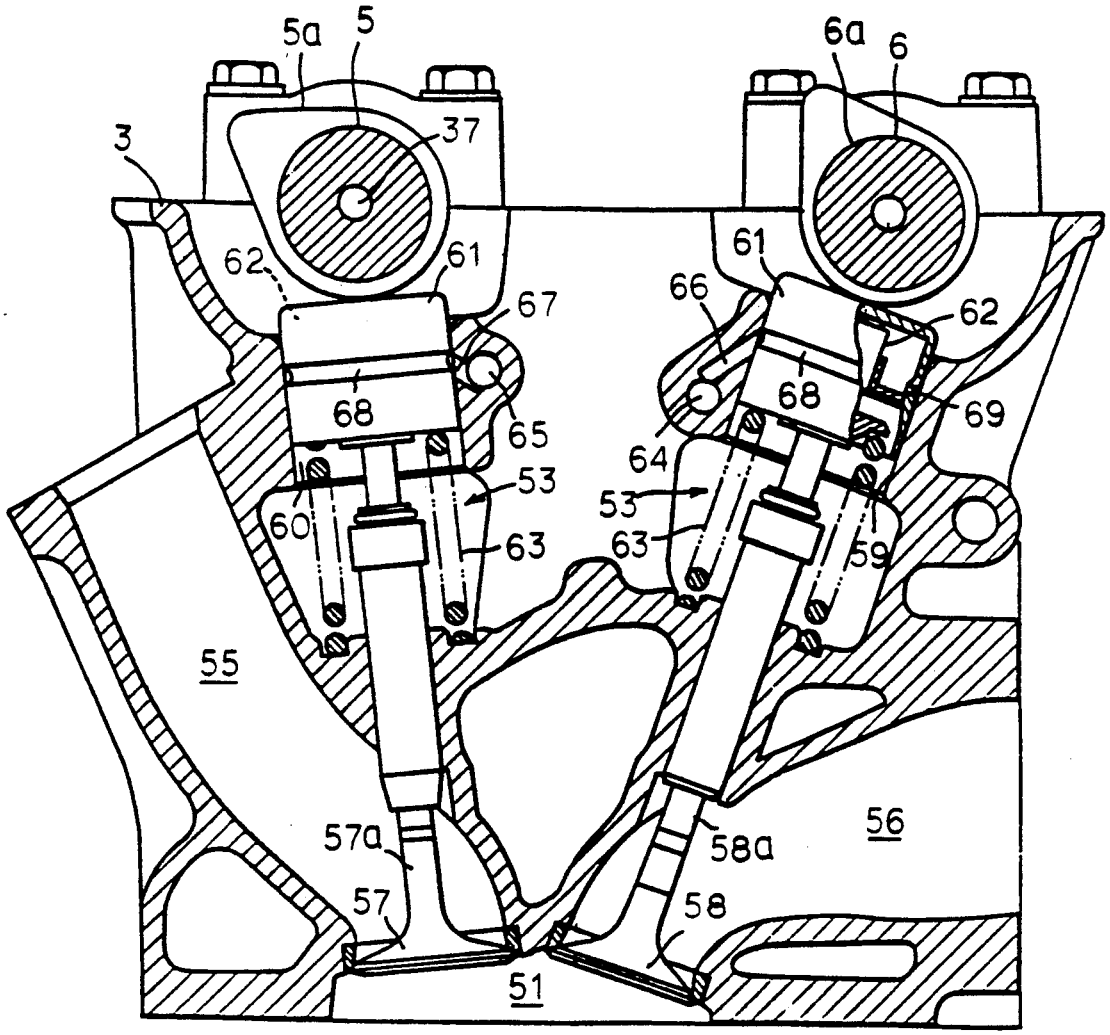
FIG. 4 is a cross-sectional view of one cylinder bank of the engine of FIG. 1.

As is shown in FIG. 4, the cylinder head 3 is formed with a combustion chamber 51, intake ports 56 and exhaust ports 55, which open into the combustion chamber 51. The intake ports 56 and exhaust ports 55 are opened and shut at a desired timing by intake and exhaust valves 58 and 57, respectively.

Each intake valve 58 is driven by a valve drive mechanism 53, including a bucket-type tappet 61 received in a tappet chamber 59 formed in the cylinder head 3. The tappet 61 has therein a hydraulic lash adjuster 62, well known in the art, to which a valve stem 58*a* of the intake valve 58 is connected. The tappet 61 is urged upward by a compression coil spring 63 so as to be kept in contact with the cam 6*a* of the intake camshaft 6. Similarly, each exhaust valve 57 is driven by a valve drive mechanism 53, installed in a tappet chamber 60 formed in the cylinder block 4. The valve drive mechanism for each exhaust valve 57 is basically identical in structure and function as that for each intake valve 58.

In order to deliver oil into the tappet chambers 59 and 60 for lubricating the tappets 61, the cylinder head 4 is formed with oil passages 64 and 65 communicating with the tappet chambers 59 and 60 through inlet ports 66 and 67. The lubrication oil from each inlet port 66 or 67 is distributed not only between the tappet 61 and the tappet chamber 59 or 60, but also into the inside of the tappet 61 and then to the lash adjuster 62 through a circumferential groove 68 and radial holes 69 formed in the side wall of the tappets 61.

Figure 5:
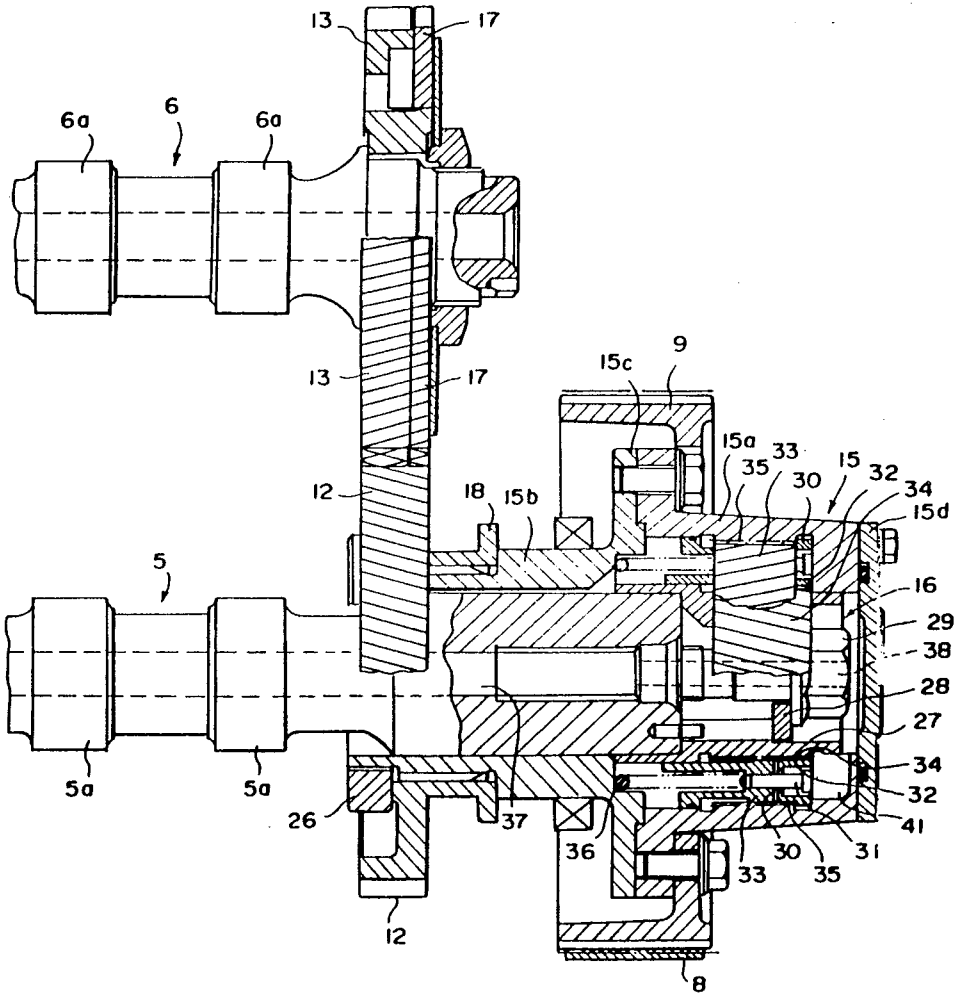
FIG. 5 is a cross-sectional view showing a variable valve timing mechanism of the valve drive mechanism installed in the engine of FIG. 1.

Referring to FIG. 5, which shows the variable valve timing mechanism 16 in detail, the housing 15 consists of front and rear, half cylindrical, open ended housing sections 15*a* and 15*b*, including flanges 15*c*. The camshaft drive sprocket 9 is bolted to the flanges 15*c* of the front and rear half housing sections 15*a* and 15*b*. The front open end of the front half housing second 15*a* is covered up by a cover 15*d* bolted thereto. The rear half housing section 15*b* is mounted for rotation on the exhaust camshaft 5. The first helical gear 12 is key-spline coupled to a rear portion of the rear half housing section 15*b* and is fixedly held by a locking nut 26 threadingly engaged with the rear end of the rear half housing section 15*b*.

Exhaust, or drive, camshaft 5 is provided at its front end portion with a cylindrical spacer 27 bolted thereto by a fastening bolt 29 through a stopper 28. In the front half housing section 15*a* of the housing 15, a cylindrical slidable element, such as a cylindrical hydraulic piston 30, is fitted or mounted on the cylindrical spacer 27. The piston 30 comprises two annular parts united together as one annular unit by a plurality of setting pins 31 arranged at circumferentially regular angular spacings. The piston 30 is formed, on its inner and outer surfaces, with internal and external helical splines 32 and 33, oriented in opposite directions, respectively. The cylindrical spacer 27 is formed on its outer surface with helical spline 34, which is in mesh with the internal helical spline 32 of the piston 30. The front half housing section 15*a* of the housing 15 is formed, on its inner surface, with helical spline 35, which is in mesh with the external helical spline 33 of the piston 30. Disposed in the housing 15 is a compression coil spring 36 for urging the piston 30 forwardly. It is to be noted that the helical threads of the helical gear 12 are cut in the same direction as the external helical splines 33 and 35 of the annular piston element 30 and the housing 15, respectively, and have the same helix angle.

Exhaust camshaft 5 is formed along its length with an axial oil passage 37, which is in communication with a through bore 38 formed in the fastening bolt 29. Facing the front end of the annular piston 30, the front half housing section 15*a* of the housing 15 is provided with an oil chamber 41, into which a hydraulic pressure is created by oil introduced thereinto through the oil passage 37 of the exhaust camshaft 5 and the through bore 38 of the fastening bolt 29.

When the hydraulic pressure created in the oil chamber 41 rises sufficiently to hydraulically urge the piston 30 against the compression spring 36, the piston 30 moves axially rearward. As the piston 30 moves axially rearwardly, the cylindrical spacer 27 and the housing 15, which are operationally coupled to the piston 30 through their spline engagement, are forced to cause a relative rotational movement therebetween. As a result, the exhaust camshaft 5, integral with the cylindrical spacer 27, shifts its angular position relative to the camshaft drive sprocket 9, so that the angular phase between the camshafts 5 and 6, and, therefore, the valve timing of the intake valves relative to the valve timing of the exhaust valves is varied.

Oil is introduced into the oil chamber 41 through the oil passage 37 by a controller including a control valve, which is well known in the art and not shown in the drawings. The amount of oil introduced is varied, according to engine operating conditions, such as engine loads (which may be determined from throttle openings) and engine speeds. That is, when the engine operates at higher engine loads and higher engine speeds, the controller introduces oil into the oil chamber 41 of the variable valve timing mechanism 16 so as to delay the valve timing and make the valve overlap between the intake and exhaust valves larger in angle, or longer in time. On the other hand, when the engine operates at lower engine loads and lower engine speeds, the controller shuts down the introduction of oil into the oil chamber 41 of the variable valve timing mechanism 16 so as to advance the valve timing and make the valve overlap between the intake and exhaust valves smaller in angle, or shorter in time.

In the variable valve timing mechanism 16, the helical threads of the helical gear 12 and the internal helical splines 35 of the housing 15 are cut in opposite directions. Therefore, an axial reactive force produced by the variable valve timing mechanism 16 during its operation acts in a direction opposite to the direction in which an axial thrust, which accompanies the turning of the intake camshaft 6 for delaying and advancing the valve timing, acts. Therefore, a composite force, acting on the variable valve timing mechanism 16, is not so large as to force the housing 15 relative to the cylinder head 3, so that a decreased axial thrust is transmitted to the intake camshaft 6 during variation of the valve timing. Furthermore, the piston 30 of the variable valve timing mechanism 16 is forced by the compression coil spring 36 to its original position without being adversely affected by an axial thrust produced by the first helical gear 12.

Groove 23 for the drive or exhaust camshaft 5, which is provided with an axial clearance C1 smaller than an axial clearance C2 of the groove 24 for the driven or intake camshaft 6, limits an axial thrust produced by the operation of the variable valve timing mechanism 16 which could possibly be transmitted from the drive side to the driven side. This prevents the driven, intake camshaft 6 both from receiving the axial thrust and from being subjected to an axial movement. This controls errors in valve timing caused by the intake camshaft 6. Furthermore, almost all of the thrust force produced during the operation of the valve drive mechanism and imposed on the exhaust and intake camshafts 5 and 6 is received by the flange 18 on a drive side of the engine body, i.e., the side of the engine body having the exhaust, drive camshaft 5. This makes it possible for the driven, intake camshaft to be provided with a flange 19 of small diameter and to decrease the size of the flange 19.

Figure 6:
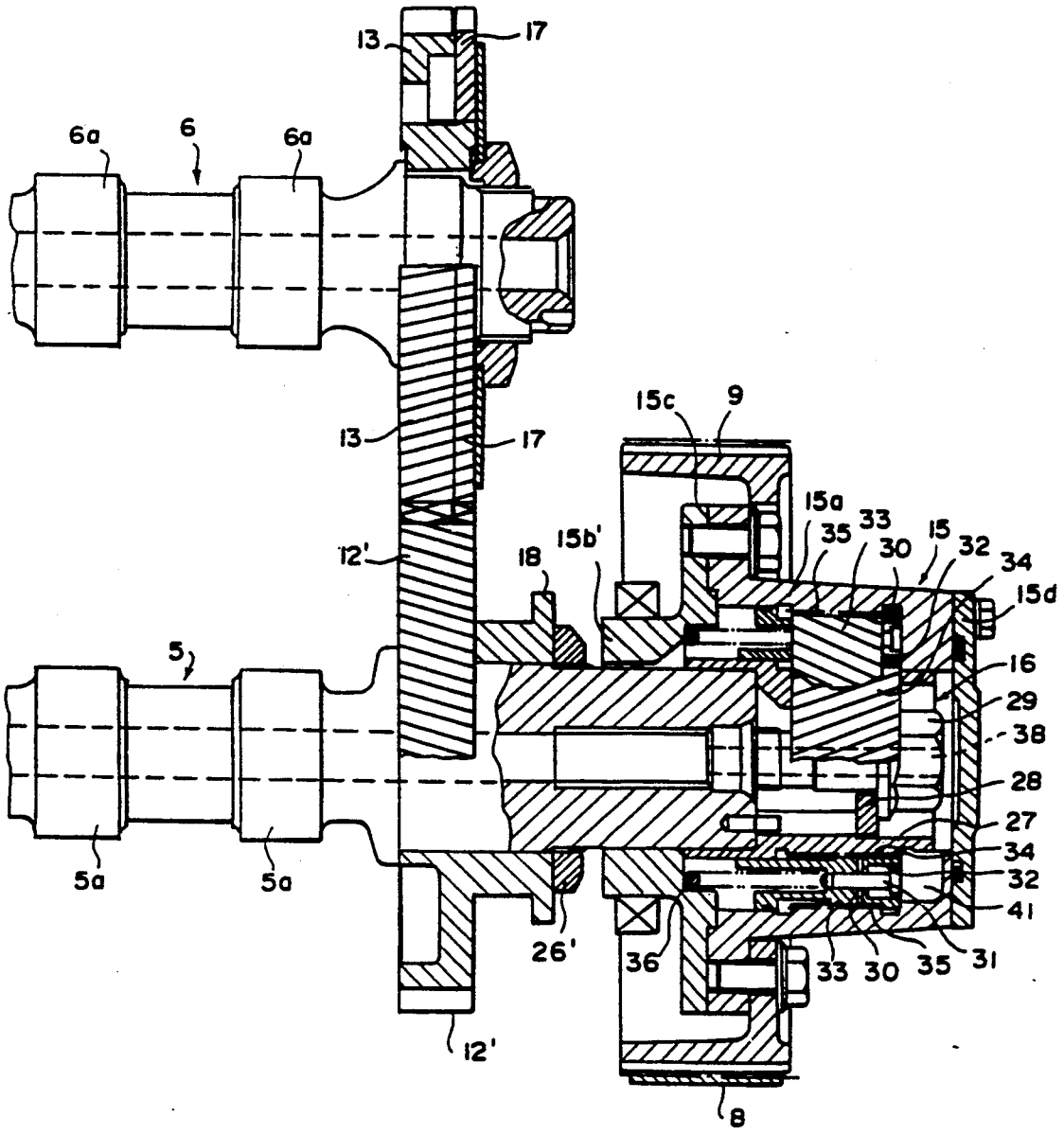
FIG. 6 is a cross-sectional view, similar to FIG. 5, showing a variable valve timing mechanism of the valve drive mechanism in accordance with another preferred embodiment of the present invention.

Referring to FIG. 6, a variant of the variable valve timing mechanism 16 is shown. This variant includes a helical gear 12' rigidly secured to a drive, exhaust camshaft 5 rather than to a housing 15. A rear half housing section **15*b'* of a housing is mounted on the exhaust camshaft 5 for rotation. The helical gear 12' is mounted on the exhaust camshaft 5, independently from the rear half housing section 15*b'* of the housing 15. The helical gear 12' is rigidly fixed by a lock nut 26' to the exhaust camshaft 5. In this variant, the helical threads of the helical gear 12' are cut in a direction opposite to the direction in which the internal helical splines 32 of the piston 30 and the helical splines 34 of the cylindrical spacer 27** are cut.

When the valve timing varying mechanism 16 is actuated, the drive, exhaust camshaft 5 is forced to turn relative to the camshaft drive sprocket 9, so as to vary the valve timing of the exhaust valves. This relative turning of the exhaust camshaft 5 is transmitted to the driven, intake camshaft 6 through the helical gears 12' and 13 in mesh with each other, so as to vary the valve timing of the intake valves. That is, the valve timing of the intake valves is delayed if the valve timing for exhaust valves is advanced, or vise versa. The axial reactive force, produced by the axial movement of the piston 30 during operation of the variable valve timing mechanism 16, acts in a direction opposite to the direction in which the thrust force imposed on the first helical gear 12' by the turn of the driven, intake camshaft 6 acts. Therefore, forces applied to, or acting on, the drive, exhaust camshaft 5 are canceled.

Figure 7:
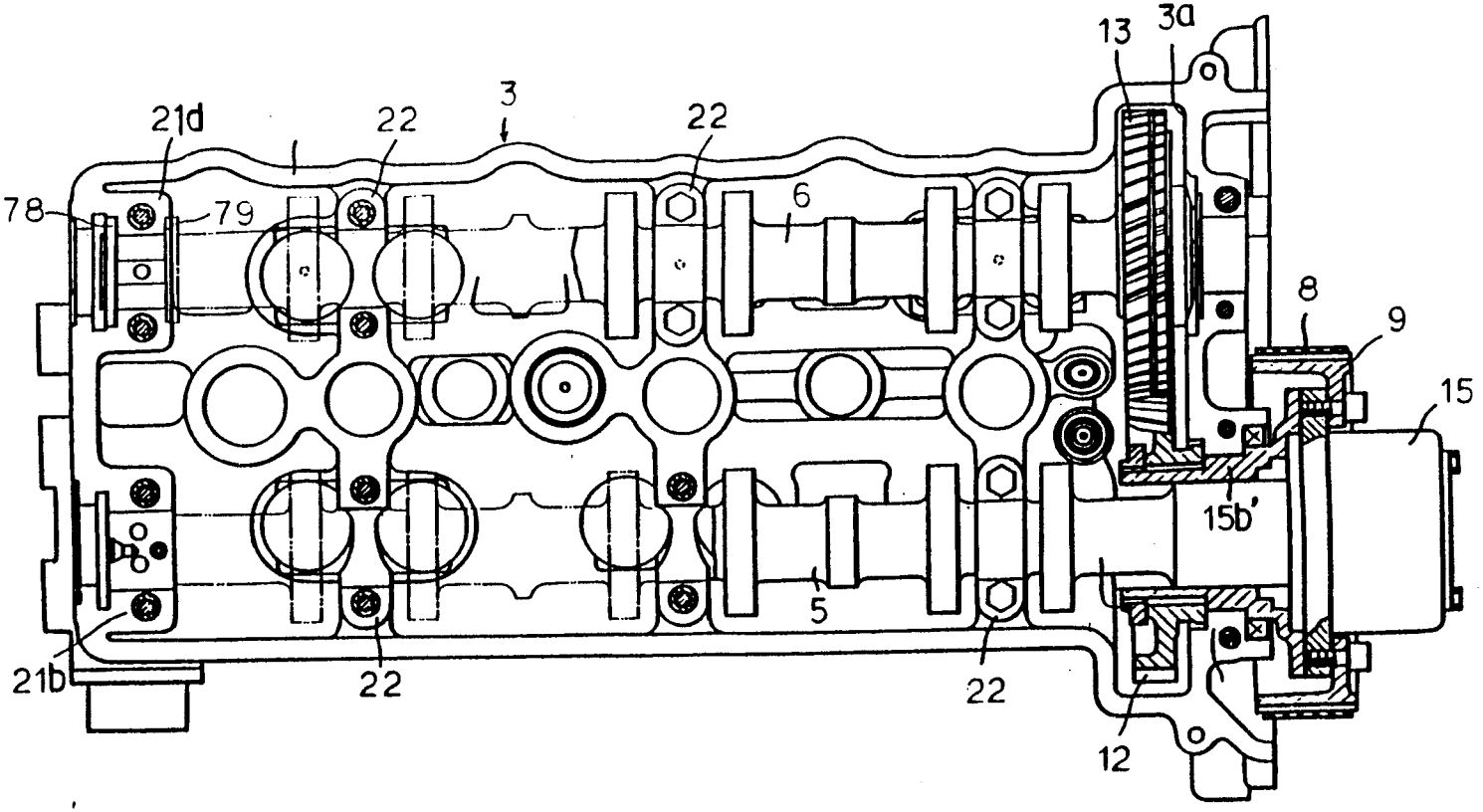
FIG. 7 is a top view of a cylinder head of one cylinder bank of a V-type engine having double overhead camshafts with a variable valve timing mechanism of the valve drive mechanism in accordance with the other preferred embodiment of the present invention shown in FIG. 6.
Figure 8:
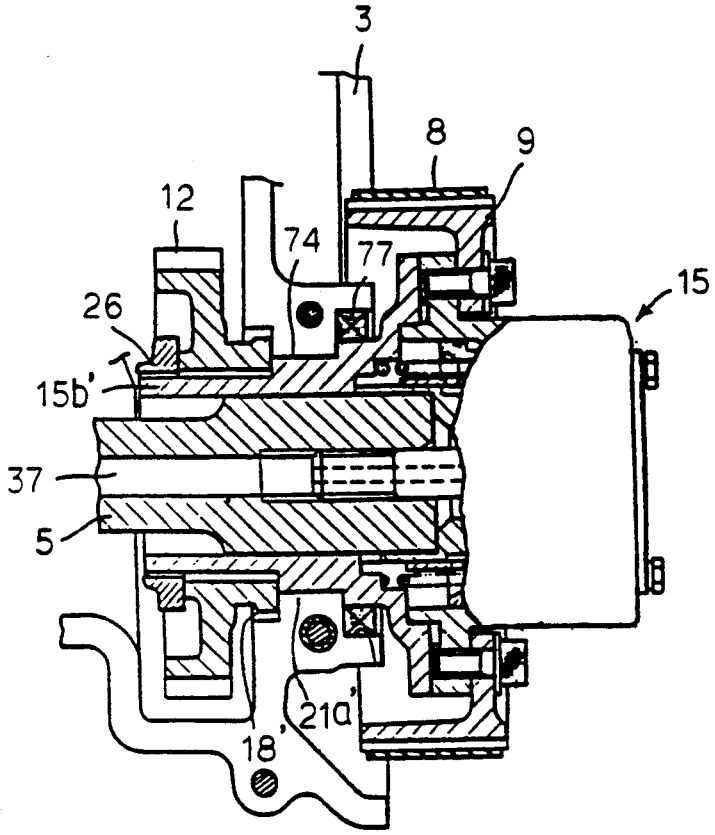
FIG. 8 is a cross-sectional view showing a bearing mechanism of a driven overhead camshaft of the valve drive mechanism.
Figure 9:
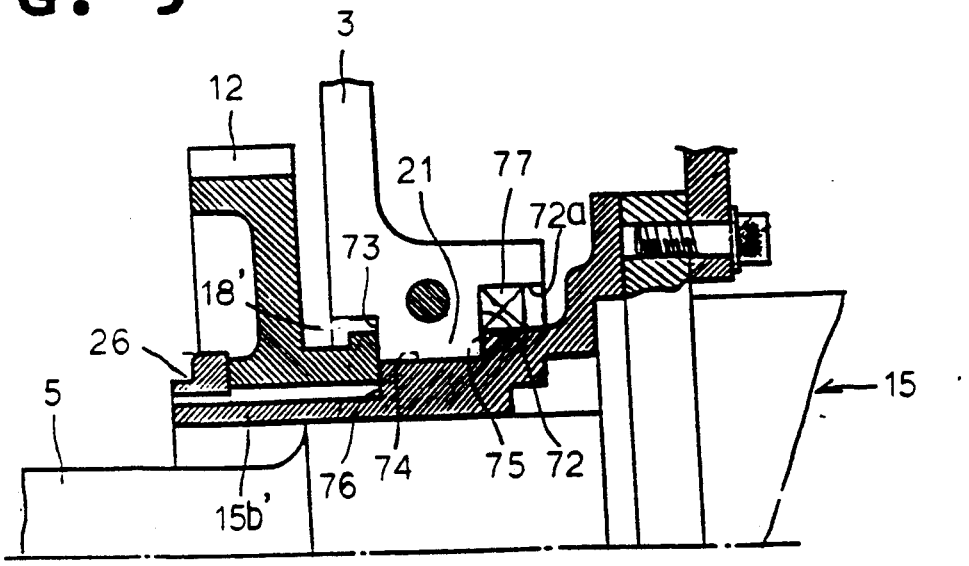
FIG. 9 is an enlarged view showing details of part of the bearing mechanism of FIG. 8.

Referring to FIGS. 7 to 9, showing a variant of the valve drive mechanism shown in FIG. 1 to 4, the exhaust overhead camshaft 5 is positioned in a thrust, or lengthwise, direction by a novel structure. The lower half journal bearing **21*a'* is formed with a bearing surface defined between front and rear semi-circular shoulders 72 and 73. The rear half housing section 15*b'* of the housing 15 is formed with a stepped annular portion 74 between front and rear circular shoulders 75 and 76. The stepped annular portion 74 of the rear half housing section 15*b'* of the housing 15 has the same length as the width of the bearing surface of the journal bearing 21*a'* and the same outer diameter as the inner diameter of the journal bearing 21*a'*. When the exhaust camshaft 5, with the valve timing varying mechanism 16 encased in the housing 15, is assembled to the cylinder block 3, the stepped annular portion 74 of the rear half housing section 15*b'* of the housing 15 is snugly seated in the journal bearing 21*a'* with front shoulders 72 and 75 engaged with each other and rear shoulders 73 and 76 arranged so as to be even. Further, the first helical gear 12, spline coupled to the rear half housing section 15*b'* of the housing 15, brings the flange 18 thereof into abutment against both the rear shoulders 73 and 76 of the journal bearing 21*a* and the rear half housing section 15*b'* of the housing 15, respectively. By tightly fastening the locking nut 26 to the rear half housing section 15*b'* of the housing 15, the front lower half of journal bearing 21*a* is firmly grasped by, and between, the flange 18 of the first helical gear 12 and the front shoulder 75 of the rear half housing section 15*b'* of the housing 15. Accordingly, the exhaust camshaft 5 is precisely positioned in the thrust, or lengthwise, direction. In a space 72*a* formed between the front shoulders 72 and 75 of the journal bearing 21*a* and the rear half housing section 15*b'* of the housing 15, an oil seal ring 77 is disposed. The intake camshaft 6 may be formed with a pair of flanges (not shown) received in a pair of grooves 78 and 79 formed in the rear journal bearing 21*d***.

This supporting structure of the exhaust overhead camshaft 5 increases a contact area between the exhaust overhead camshaft 5 and the rear half housing section 15*b'* of the housing 15, so that it is not necessary for the journal bearing 21*a* to have a wide bearing surface for supporting the exhaust camshaft 5 by the variable valve timing mechanism 15.

It is to be understood that although the present invention has been described in detail with respect to preferred embodiments thereof, various other embodiments and variants are possible which fall within the scope and spirit of the invention, and such other embodiments and variants are intended to be covered by the following claims.

What is claimed is:

1. A valve drive mechanism for an internal combustion engine, comprising:

an intake overhead camshaft having one cam for driving each intake valve of the internal combustion engine;

an exhaust overhead camshaft, in juxtaposition with said intake overhead camshaft, having one cam for driving each exhaust valve of the internal combustion engine, said exhaust overhead camshaft being operationally coupled to said intake overhead camshaft;

camshaft drive means for transmitting engine output from a crankshaft of the internal combustion engine to one of said intake and exhaust overhead camshafts;

gear means for connecting rotation of said one of said intake and exhaust overhead camshafts to another of said intake and exhaust overhead camshafts, said gear means comprising helical gears in mesh with each other; and variable valve timing means for varying a valve timing at which one of said intake and exhaust valves is driven relative to a valve timing at which the other of said intake and exhaust valves is driven;

said variable valve timing means having slidable means, mounted on said one of said intake and exhaust overhead camshafts for axial displacement, for operationally coupling said one of said intake and exhaust overhead camshafts to said camshaft drive means so as to cause a relative rotational displacement therebetween when said slidable means causes axial displacement with respect to said one of said intake and exhaust overhead camshafts, said slidable means comprising cylindrical piston means with internal and external helical coupling means for coupling with said one of said intake and exhaust overhead camshafts and said camshaft drive means, respectively, said internal and external helical coupling means, respectively, comprising helical splines cut in opposite directions, said camshaft drive means including internal helical splines cut in a direction opposite to helical threads of one of said helical gears mounted on said one of said intake and exhaust overhead camshafts.

2. A valve drive mechanism as defined in claim 1, wherein said cylindrical piston means comprises a cylindrical hydraulic piston mounted on said one of said intake and exhaust overhead camshafts.

3. A valve drive mechanism as defined in claim 2, wherein said cylindrical piston means further comprises a cylindrical housing rigidly connected between said camshaft drive means and said gear means for connecting rotation of said one of said intake and exhaust overhead camshafts, and operationally coupled to said cylindrical hydraulic piston by said external helical coupling means so as to form therein a hydraulic pressure chamber.

4. A valve drive mechanism as defined in claim 1, wherein said gear means comprises a first gear coaxially mounted on said one of said intake and exhaust overhead camshafts and a second gear, in mesh with said first gear, coaxially secured to the other of said intake and exhaust overhead camshafts.

5. A valve drive mechanism as defined in claim 4, wherein each of said first and second gears comprises a helical gear.

6. A valve drive mechanism as defined in claim 1, wherein said gear means comprises first and second gears, in mesh with each other, coaxially secured to said intake and exhaust overhead camshafts, respectively.

7. A valve drive mechanism as defined in claim 6, wherein each of said first and second gears comprises a helical gear.

8. A valve drive mechanism as defined in claim 7, wherein said one of said intake and exhaust overhead camshafts is supported by tightly holding a bearing provided on said internal combustion engine in a lengthwise direction thereof between said first gear and a housing of said variable valve timing means.

9. A valve drive mechanism as defined in claim 8, wherein said variable valve timing means is mounted on said exhaust overhead camshaft.

10. A valve drive mechanism for an internal combustion engine, comprising:

an intake overhead camshaft having one cam for driving each intake valve of the internal combustion engine;

an exhaust overhead camshaft, in juxtaposition with said intake overhead camshaft, having one cam for driving each exhaust valve of the internal combustion engine, said exhaust overhead camshaft being operationally coupled to said intake overhead camshaft;

camshaft drive means for transmitting engine output from a crankshaft of the internal combustion engine to one of said intake and exhaust overhead camshafts;

gear means for connecting rotation of said one of said intake and exhaust overhead camshafts to another of said intake and exhaust overhead camshafts, said gear means comprising a first gear coaxially mounted on said one of said intake and exhaust overhead camshafts and a second gear, in mesh with said first gear, coaxially secured to the other of said intake and exhaust overhead camshafts, each of said first and second gears comprising a helical gear;

variable valve timing means for varying a valve timing at which one of said intake and exhaust valves is driven relative to a valve timing at which the other of said intake and exhaust valves is driven, said variable valve timing means having slidable means, mounted on said one of said intake and exhaust overhead camshafts for axial displacement, which operationally couples said one of said intake and exhaust overhead camshafts to said camshaft drive means so as to cause a relative rotational displacement therebetween when said slidable means causes axial displacement with respect to said one of said intake and exhaust overhead camshafts; and thrusts restraining means for allowing a different lengthwise movement of said one of said intake and exhaust overhead camshafts than of the other of said intake and exhaust overhead camshafts.

11. A valve drive mechanism as defined in claim 10, wherein said variable valve timing means is mounted on said exhaust overhead camshaft.

* * * * *